US005855972A

United States Patent [19]

Kaeding

[11] Patent Number: 5,855,972

[45] **Date of Patent: *Jan. 5, 1999**

[54] SEALANT STRIP USEFUL IN THE FABRICATION OF INSULATED GLASS AND COMPOSITIONS AND METHODS RELATING THERETO

[76] Inventor: Konrad H Kaeding, 20 Ocheltree Dr. (Wood Creek), Wilmington, Del. 19808

[ * ] Notice: The terminal 9 months of this patent has been disclaimed.

[21] Appl. No.: 332,886

[22] Filed: Nov. 1, 1994

Related U.S. Application Data

[63] Continuation-in-part of Ser. No. 150,972, Nov. 12, 1993, abandoned.

[51] Int. Cl.[6] ..... E06B 3/663

[52] U.S. Cl. ..... 428/34; 428/448; 428/450; 428/465

[58] Field of Search ..... 428/34, 250, 465, 428/448, 450

[56] References Cited

U.S. PATENT DOCUMENTS

| | | | |
|---|---|---|---|
| 3,771,276 | 11/1973 | Stewart et al. | 52/172 |
| 4,109,431 | 8/1978 | Mazzoni et al. | 52/172 |
| 4,145,237 | 3/1979 | Mercier | 156/107 |
| 4,198,254 | 4/1980 | Laroche et al. | 156/107 |
| 4,215,164 | 7/1980 | Bowser | 428/34 |
| 4,348,435 | 9/1982 | Mistrick et al. | 428/34 |
| 4,431,691 | 2/1984 | Greenlee | 428/52 |
| 4,614,676 | 9/1986 | Rehfeld | 428/34 |
| 4,622,249 | 11/1986 | Bowser | 428/34 |
| 4,817,354 | 4/1989 | Bayer | 52/302 |
| 4,942,704 | 7/1990 | King | 52/171 |
| 4,952,430 | 8/1990 | Bowser | 428/34 |
| 4,994,309 | 2/1991 | Reichert et al. | 428/34 |
| 5,033,249 | 7/1991 | Scheeren et al. | 52/49 |
| 5,088,258 | 2/1992 | Schield | 52/398 |
| 5,162,445 | 11/1992 | Powers et al. | 525/333 |
| 5,177,916 | 1/1993 | Misora et al. | 52/172 |
| 5,254,377 | 10/1993 | Lingemann | 428/52 |
| 5,270,091 | 12/1993 | Krysiak et al. | 428/34 |

FOREIGN PATENT DOCUMENTS

| | | | |
|---|---|---|---|
| 1384127 | 2/1975 | United Kingdom | 428/34 |

OTHER PUBLICATIONS

Exxon Bronco XP–50 Rubber, Compounding and Applications by Exxon Chemical, May, 1992.

*Primary Examiner*—Marion E. McCamish
*Assistant Examiner*—Elizabeth M. Cole

[57] ABSTRACT

An insulated glass unit comprising two panes of glass and a sealant strip disposed around the periphery of the two panes in order to form a sealed space. The sealant strip is an isobutylene copolymer grafted with an organo-silane and includes 15–50 weight percent tackifier. The sealant strip is self splicing and is preferably sufficiently compression resistant so that additional compression resistant inserts or reinforcements are unnecessary.

5 Claims, 4 Drawing Sheets

SEALANT STRIP USEFUL IN THE FABRICATION OF INSULATED GLASS AND COMPOSITIONS AND METHODS RELATING THERETO

RELATED APPLICATIONS

This is a continuation-in-part of U.S. Ser. No. 08/150,972, filed Nov. 12, 1993, now abandoned.

FIELD OF THE INVENTION

The present invention is directed to sealant strips for fabricating insulated glass units and related compositions and applications. In a preferred embodiment, the sealant strip comprises a sealant having a modified isobutylene copolymer.

BACKGROUND OF THE INVENTION

U.S. Pat. No. 5,270,091 to Krysiak is directed to a window strip for use in fabricating insulated glass. Such strips have been problematic however, because they require a compression resistant spacer and a deformable sealant, and such a design is not well suited to handle the stresses (i.e., temperature cycling, wind forces, and the like) which are commonly encountered by insulated glass units.

U.S. Pat. No. 4,109,431 to Mazzoni is directed to a complex "sealing and spacing unit for multiple glazed windows" comprising a moisture impervious base layer which is wrapped around the outer peripheral surfaces of two parallel (spaced apart) glass panes, a spacer-dehydrator inserted between the glass panes, a thin layer of non-mastic adhesive which secures the spacer dehydrator to the base layer and a cold flowable mastic to seal the base layer to the peripheral outer surfaces of the glass panes.

Pressure sensitive adhesives (PSAs) in general are well known. One broad class of such adhesive compositions are "rubber based" PSAs, typically comprising tackifier and one or more (low glass transition temperature, i.e., less than about 0° F.) rubbery base polymers. Common rubber based pressure sensitive adhesive compositions include those comprising isobutylene homopolymer or copolymer. Isobutylene polymers not only have excellent flow onto many substrates, but also, the polymers will generally crystallize as they are stretched and pulled from a substrate, thereby providing exceptional peel strength.

However, rubber based PSAs are not without their shortcomings. First, such materials generally have difficulty flowing onto (penetrating) glass, acrylics (i.e., automotive paints), polyethylene, ceramics, and the like. Second, regardless of surface penetration, the rubber based PSAs will generally have difficulty "anchoring" or "holding" onto a substrate, where there is chemical incompatibility between the PSA and the substrate.

Another broad class of pressure sensitive adhesives are known as "acrylic" PSAs. In many instances, acrylic PSAs have excellent flow and compatibility with polar substrates, relative to rubber based PSAs (and also generally can be formulated without tackifier). However, acrylic PSAs can be expensive, can be difficult to formulate for creep resistance, can be difficult to formulate for resistance to moisture, can be difficult to adhere to non-polar or low surface energy surfaces, and must generally be applied as a liquid or semi-liquid.

A need therefore exists for pressure sensitive adhesives having many of the advantages of conventional (acrylic and rubber based) PSAs, without many of the disadvantages.

A conventional rubber based PSA is polyisobutylene or "PIB." Another conventional such material is commonly referred to as "butyl" or "butyl rubber" and is derived from isobutylene and a relatively small amount of isoprene; the isoprene is generally used to provide unsaturation to the isobutylene polymer, thereby allowing the resulting polymer to be crosslinked (or crosslinkable). Butyl rubbers can be brominated or chlorinated.

Brominated para-methyl styrene/isobutylene copolymers have been developed by and are commercially available through the EXXON Chemical Company of Houston Tex., U.S.A. (see generally, U.S. Pat. No. 5,162,445 to POWERS). These polymers are taught to be crosslinked by conventional high temperature post curing.

U.S. Pat. No. 5,242,727 to BRIDDELL is directed to a roofing membrane adhesive, and in one embodiment, BRIDDELL teaches the use of a halogenated copolymer of p-methylstyrene/isobutylene. BRIDDELL teaches conventional high temperature post curing and is directed to EPDM based compositions.

Apart from adhesion, certain preferred polymers can be designed to provide compatibalization between dissimilar polymers and can therefore be useful in the art of blending or alloying dissimilar polymers or compositions. Polymer blending and alloying in generally is known, and compatibilizers in general are also known. However, the polymers of the present invention are far removed from conventionally known compatibilizers, and in certain embodiments, polymers of the present invention can provide a whole new class of advantageous polymer blends and alloys.

SUMMARY OF THE INVENTION

Overview

The present invention is directed to sealant strips for fabricating insulated glass units and related compositions and applications. In a preferred embodiment, the sealant strip comprises a sealant having a modified isobutylene (or similar-type) copolymer.

The modified isobutylene copolymer generally provides improved adhesion (particularly improved substrate wetting capability) to a wide variety of substrates (including glass, rubber and plastic) relative to conventional isobutylene based sealants. The present invention is also directed to other uses of these modified isobutylene copolymers, such as: 1. incorporating the copolymers into hot melts, pumpables (i.e., caulks) and similar-type adhesives or sealant compositions; and 2. using the copolymers as compatibalizing agents for blending or alloying dissimilar polymers or the like.

The window strip preferred embodiment of the present invention will be discussed first. Thereafter modified base copolymers will be described which are particularly useful in the formulating of appropriate sealants for use in the sealant strip embodiment of the present invention. Finally, alternative uses for these copolymers will be described.

"Sealant" as used herein is intended to mean any composition which provides adhesion to a substrate or sealing between substrates, including caulks, hot melts, pressure sensitive adhesives, curable compositions, non-curable compositions and the like.

Insulated Glass Sealant Strip

The sealant strips of the present invention are preferably pulled from a roll, placed around the periphery of a first glass pane, covered by a second glass pane and compressed between the two glass panes, thereby creating a durable, double-paned window system having a reliably sealed air space between the two panes. In a preferred embodiment, the window strip comprises a vapor barrier, a base matrix and (optionally) a desiccating material.

The strip can be rectangular, concentric, eccentric or any variation thereof. In the most preferred embodiment, the strip is rectangular. Superior cornering and accommodation of glass movement can be accomplished where the width of the strip is less than or about equal to one half the height of the strip, for strips of about one half an inch and greater.

The vapor barrier can be any flexible material capable of providing a moisture barrier, such as, a self-supporting or non-self supporting layer (non-self supporting layers are supported by support layers such as polyolefin or polyester) of metal, polyvinylidene chloride, polyolefin, silicone oxide, nylon, polyester or the like. Preferably, the vapor barrier is a multilayer structure comprising a support layer of paper or plastic (preferably polyethylene terephthalate) which support a vapor barrier layer of metal, polyvinylidene chloride, glass or the like. An adhesive layer may be necessary in bonding the vapor barrier to the support layer. In an alternative embodiment, the vapor barrier is rigid and compression resistant.

Compressible vapor barrier films, such as metalized films, are well know and available from any one of a number of film suppliers, including E. I. du Pont de Nemours And Company ("DuPont") of Wilmington, Del., U.S.A. Preferably, the vapor barrier has little or no compressive strength (has no ability to resist the compressive forces typical in the assembly of an insulated glass unit).

The optional desiccating material can be any conventionally known dessicating material, but preferably is a molecular sieve. A preferred loading of molecular sieve powder is in the range of about 2 to about 25 weight percent, more preferably about 5 to 15 weight percent based upon the weight of the window strip sealant. Alternatively, the air space sealed by the window strip can be desiccated by a desiccant which is in contact with the air space but is not incorporated into the window strip, per se.

The base matrix is the material which adheres and seals between the two panes of glass. The base matrix will generally comprise a base polymer, and optionally other polymers, tackifiers, curatives, fillers, processing aids, pigments and/or other ingredients commonly used in pressure sensitive sealant chemistry.

Preferably, the base matrix is compression resistant, whereby the base matrix can deform in response to forces applied to the base matrix during insulated glass fabrication (base matrix flexibility is helpful in accommodating stresses commonly encountered by insulated glass units), but will have memory and therefore will return to its original shape, once such stresses are removed, either during insulated glass fabrication or thereafter (the compression set, if any is preferably less than about 5 mils, more preferably less than about 2 mils, and yet more preferably less than about 1 mil). The preferred base matrix materials of the present invention have high resilience, high tensile strength, excellent resistance to tear (flexing, freezing and abrasion), and low permanent set (will recover most of its original dimensions after extension).

On the other hand, if the sealant (for use in the fabrication of an insulated glass unit) is deformable during initial fabrication, a discontinuous compression resistant insert (such as a staple) or a continuous compression resistant strip can be incorporated into the sealant. Such a design is less preferred however, since it will be less able to accommodate stresses commonly placed upon insulated glass units.

Crosslinking, heavy branching (or grafting) or high loadings of reinforcing fillers can provide compression resistance and also can substantially eliminate unwanted creep or flow. However, the base matrix should provide reliable bonding to glass and should provide some movement capability to accommodate stresses on the insulated glass unit. By allowing to be easily stretched or compressed by just a few mils or so, the stresses on the window system are dramatically reduced, since the change in volume will offset the change in pressure due to the change in temperature. Particularly useful base matrix materials can be formulated with crosslinked or uncrosslinked grafted isobutylene base polymers as further described below.

A Precursor Polymer For Synthesizing The Preferred Base Polymer

The preferred graft modified polyisobutylene base polymers useful for the present invention are derived from a polyisobutylene precursor copolymer. This precursor polyisobutylene copolymer is preferably synthesized by a conventional Friedel-Crafts copolymerization of:

1. at least about 80 weight percent (more preferably at least about 90 weight percent, yet more preferably at least about 95 weight percent and most preferably at least about 97 weight percent) isobutylene; and
2. about 0.1 to about 35 weight percent (more preferably about 0.4–9 weight percent) multifunctional monomer or oligomer, such as, isoprene (which would then result in a "butyl" type polyisobutylene copolymer precursor available from any one of a number of butyl rubber commercial suppliers, such as the Exxon Chemical Co.) or paramethyl styrene (which would result in an "Exxpro®" type polyisobutylene copolymer precursor also available from the Exxon Chemical Co.).

The resulting copolymer is preferably halogenated by conventional means, most preferably brominated (bromination can be accomplished by subjecting the copolymer to bromine gas in the presence of ultraviolet light or heat).

Two of the most preferred such halogenated copolymers (useful as the polyisobutylene copolymer precursor) are commercially available as:

1. "bromo butyl" available from a number of rubber chemical companies, including Exxon Chemical Co. of Houston, Tex., U.S.A. (the synthesis of bromo butyls is well known to those of ordinary skill in the art); and
2. "Exxpro®" brand brominated para-methyl styrene/isobutylene ("PMSI") copolymer, available from Exxon Chemical Co. of Houston, Tex., U.S.A. (brominated PMSI copolymers and the process for manufacturing such copolymers are described in U.S. Pat. No. 5,162,445 to POWERS).

The most preferred polyisobutylene copolymer precursor is Exxpro® brand brominated PMSI.

From Precursor To Preferred Base Polymer

The isobutylene copolymer precursor comprises an isobutylene backbone having a moiety which is reactive with an oligomer or a polymer segment, thereby allowing the grafting of the segment onto the precursor polymer. In the preferred embodiments, the allyl bromide (in the case of a bromo butyl precursor) or the benzyl bromide (in the case of an Exxpro® PMSI type precursor) is reacted with a segment having a nucleophilic moiety, most preferably a nucleophilic moiety which will preferably also abstract the halogen (i.e., bromine) from the precursor copolymer as it covalently bonds to the precursor copolymer. The grafting reaction is preferably accomplished by heat mixing, such as, conventional pre-compounding or direct fabrication by means of an extruder or the like.

Preferred Graft Segments For The Preferred Base Polymer

For use in a sealant formulation, the following polar organic or inorganic grafting segments are preferred:

1. an inorganic, such as, a siloxane or a polysulfide, particularly those having silol and thiol functionality (alternatively, an organic-inorganic segment can be used, such as an organo-silane or organo-sulfide), and preferred such segments are siloxanes, thio-silanes, and amino-silanes; or
2. a polar organic, such as, those comprising one or more of the following: carboxylic acid, acid salt or anhydride; amine; imine; amide; oxide; epoxy; urea; urethane; ether; ester; halocarbons or the like, (i.e., oligomers derived in whole or in part from: (meth)acrylic acid, glycidyl-acrylate, styrene sulfonic acid, substituted or unsubstituted halocarbon, ethylene imine, carbon monoxide, sulfur dioxide and the like).

Amine, silanol, thiol and anhydride functionalities will generally react with a benzyl or allyl bromide by abstracting the bromine and then reacting with the benzyl or allyl carbon via a nucleophilic addition. This reaction can be accelerated by intimate mixing and heating at temperatures above about 100° F. Also useful (but generally somewhat less reactive) functionalities include proton donating organic acids and ionic salts thereof. Preferably, from about 0.5 to about 95 weight percent (more preferably about 2–50 weight percent) of the final polymer is derived from the polar organic or inorganic segment, and at least about 5% by weight of the final base polymer is derived from isobutylene (more preferably at least about 50 weight percent).

A Preferred Base Polymer: Silane Grafted Isobutylene Copolymers

Amino-silanes, thio-silanes or other silane (or organo-silane) segments can be grafted onto the precursor polymer. It has been surprisingly discovered that the adhesive properties of the resulting grafted polyisobutylene polymer is dramatically improved by the presence of the silane (particularly siloxane) segments.

It is theorized that the silane segments are sufficiently incompatible with polyisobutylene to inhibit chain entanglement and to inhibit tight compacting of the polymers. It is also theorized, that entangled isobutylene chains will move more easily relative to one another, due to the presence of the silane segments. Hence, the resulting sealant is softer and more flowable. Furthermore, the silane segments constrain the polyisobutylene segments, thereby inhibiting randomness—hence, (particularly, when used as a pressure sensitive adhesive) once the sealant permeates a substrate, a greater amount of force is generally necessary for the sealant to retract way from the substrate.

This improved flow and penetration into a substrate (due to silane grafting) is particularly pronounced when the base polymer is crosslinked, whereby the crosslinking inhibits flow and compression set, but the softness of the material provides excellent adhesion. Furthermore, it is theorized that the silane segments are very "surface seeking" and that a portion of the silane segments reach the surface of the sealant. The silane seems to provide the sealant surface with improved compatibility with many surfaces, particularly glass, metal, plastics and rubbers.

Although a multifunctional silane or organo-silane can also crosslink the polymer matrix, it is often more preferred to crosslink the polyisobutylene copolymer precursor, using conventional cure chemistry. Hence, some of the reactive sites of the polyisobutylene copolymer will preferably be used for conventional crosslinking and other sites for grafting. The preferred ratio of crosslink sites to graft sites is preferably about 5–95:95–5, more preferably about 25–75:75–25.

A preferred silane segment comprises polyalkylsiloxane, particularly polydimethylsiloxane which has a surface tension of about 21 dyne/cm, and therefore, the overall surface energy of the base polymer can be substantially lowered (for good wetting of a substrate, the sealant generally should have a surface energy equal to or less than the surface energy of the substrate). The surface energy of paraffin wax is about 23 mN/m and indeed, the silicone/isobutylene sealants of the present invention have demonstrated excellent adhesion to low surface energy substrates.

The lower surface energy of the base polymers of the present invention has also been found to be advantageous, because by lowering the overall surface energy of the base polymer, the base polymer is able to displace tackifiers having higher surface energy. In displacing tackifier, the sealant can thereby build adhesion (tackifiers are low molecular weight materials which bloom to a sealant surface and will provide initial tack but otherwise inhibit adhesion, if the base polymer is blocked by the tackifier from interacting with the substrate surface). The reduced surface energy preferred base polymer of the present invention generally reduces the degree of such blocking of the surface by a tackifier, and adhesion "build up" is improved, relative to many prior art polyisobutylene based sealant systems.

Polybutene tackifiers are generally extremely low in surface energy and therefore might at first be regarded as being less preferred for use with the base polymers of the present invention. However, it has been discovered that these tackifiers are so "surface seeking" that they tend to migrate across the interface of an EPDM roofing membrane seam (and other thermoplastic or rubber surfaces), and hence, although the base polymer may not readily displace a polybutene tackifier, the tackifier may migrate away from the interface anyway (and into the adjoining substrate). Hence, for surfaces capable of permeation by polybutene tackifier (glass and metal would generally not fall into this category), polybutene tackifiers may be quite desirable, particularly due to their low cost and excellent tack.

Also, polydimethylsiloxane (or similar-type) segments have a glass transition temperature which is generally much lower than polyisobutylene. Hence, although crosslinking will generally increase the hardness of an polyisobutylene, the polyalkylsiloxane (or similar-type) segment will lower the overall theoretical glass transition temperature of the material, and the crosslinked material will be much softer than what would otherwise be experienced with a lightly crosslinked butyl. However despite the functionalizing of the polyisobutylene, the isobutylene backbone will generally crystallize on stretching, so it generally provides advantageously high gum strength, despite the softness and wetting capability provided by the polyalkylsiloxane (or similar-type silane) segment.

Surprisingly, silicone grafted isobutylene copolymers have excellent capability of fusing to themselves, once cut and pressed together again. This property makes these compositions particularly useful in application requiring high performance self-fusing properties, such as is defined in MIL- 1-3825B and related market areas.

Alternative Base Polymer: Reactive Silane Grafted Isobutylene Copolymer

In one preferred embodiment, a preferred silane grafting segment further comprises (in addition to the moiety used to bond the segment to the precursor polymer) a silicone cure (crosslink) site. A preferred silicone cure site is a silanol or alkoxysilane (i.e., acetoxysilane) functional group which can room temperature vulcanize ("RTV"), using convention RTV silicone cure chemistry.

In the preferred silicone curing reaction, the RTV cure proceeds by hydrolytic cleavage of the alkoxy group, thereby creating a by-product and a silanol group; the resulting silanol group undertakes a condensation reaction with another alkoxy silicon, thereby perpetuating the curing reaction by creating a by-product and a silanol. The silanol reacts with an alkoxy silicone and so on (evaporation or other removal of the by-product generally drives the reaction toward completion); a conventional tin catalyst can be used which presumable forms an active complex with the polymer silanol, which then reacts with the crosslinking agent.

Other curing systems are known and employ different silane curing agents. Commercial products based on methoxysilanes and catalyzed by titanium compounds (i.e., chelates) sometimes have the advantage of releasing a hydrolysis product that is not acidic. Other products employ methoxy-functional cures catalyzed by tin compounds; methanol scavengers can be used to protect the polymer from tin-catalyzed alcoholysis.

Alkoxysilanes are generally slower cross-linking agents than acetoxysilanes. Acetic acid is the by-product of acetoxysilane hydrolysis. Acetone is the by-product from methyltris(isopropenoxy)silane hydolysis. Amido and ketoxysilanes can also be used to provide an RTV silicone based sealant. Silicone curing chemistry is well known and need not be described in any further detail here; ordinary skill and experimentation may be necessary in designing any particular silicone curing chemistry in conjunction with the base polymer, depending upon the desired end use application.

Alternative Base Polymer: Acrylic Grafted Isobutylene Copolymers

A preferred acrylic graft segment is a higher alkyl ester (preferably butyl and 2-ethylhexyl esters) of (meth) acrylic acid further comprising a moiety reactive with the isobutylene copolymer precursor (preferred reactive moieties include: (meth)acrylic acid, acrylamide, acrylonitrile, amino (meth)acrylate and the like). As used herein, "(meth)acrylic" is intended to mean either acrylic or methacrylic, and "(meth)acrylate" is intended to mean acrylate or methacrylate.

Water based acrylic pressure sensitive adhesives are well suited for use as grafting segments onto the isobutylene copolymer precursor, due to the high acid content of such acrylic compositions. Preferred grafting segments comprise about 60–98 wt % $C_4$ acrylate; 2–30 wt % polar monomer (i.e., (meth)acrylic acid); and about 0–25 weight percent modifying monomers (such as, methyl or ethyl acrylate, vinyl acetate, methyl methacrylate, and the like).

Vinyl Acetate Grafted Isobutylene Copolymers

An alternative to acrylic grafting of the isobutylene copolymer precursor is grafting the precursor with a polyvinyl acetate segment comprising (meth)acrylic acid and optionally dioctyl maleate. A preferred graft segment is derived from about 25–50 weight parts vinyl acetate, about 25–50 weight parts dioctyl maleate or the like, and about 5–25 weight parts (meth)acrylic acid. The acid moiety provides the reactive site for grafting onto the precursor copolymer.

Alternative Base Polymer Use: Medical Adhesives

Vinyl acetate grafting and acrylic grafting tend to provide increased adhesion over time and provide improved adhesion to polar substrates. These materials also can provide adhesion without the use of skin irritating tackifiers or similar type ingredients. Hence, these adhesives are well suited for external medical adhesion applications, such as bandage adhesives or the like.

Alternative Base Polymer Use: Compatibalization

A number of functionalized polymers or oligomers, including amine, imine, (meth)acrylic acid, siloxane and anhydride functionalized polymers are commercially available and can be used to bond a segment to isobutylene copolymer, whereby the hybrid polymer can act as a compatibalizer between isobutylene compatible polymers and polymers compatible with the segment. A particularly preferred family of such polymers are available from E. I. du Pont de Nemours and Company (DuPont), Wilmington, Del., U.S.A., and sold under the brand name "Fusabond®". Such Fusabond® brand polymers can be used as segments for bonding to the base polymer precursor (described above) via the reactive functionality of the Fusabond® polymers. Whereas the reactive portion of the segment polymer reacts with the precursor polymer at temperatures generally above about 200° F., more preferably above about 250° F., the remaining portion of the graft segment is preferably used for compatibalization (and/or adhesion) purposes.

The resulting base polymer will thereby have a polyisobutylene portion and a segment portion which has some incompatibility with the polyisobutylene portion. For instance, where the segment portion comprises ethylene propylene diene ("EPDM"), then the resulting base polymer will be useful in compatibalizing polyisobutylene type polymers with EPDM type polymers. The resulting polymer blend chemistry could be useful in many ways.

For instance, EPDM roofing membranes generally must have multiple plies in order to cover tiny voids or holes in each ply of the EPDM which might otherwise cause leakage or tearing problems. By using a polyisobutylene/EPDM base polymer of the present invention, a polyisobutylene type polymer can be blended with EPDM for toughening, reinforcement, improved elasticity and diminished pinholing. Furthermore, an Exxpro® brand polyisobutylene copolymer precursor can be used which is extremely resistant to ultraviolet light degradation. This added UV resistance (of the Exxpro polymer precursor) addresses a significant problem in producing non-black EPDM roofing membranes (without high loadings of carbon black, the EPDM is susceptible to UV degradation—however, UV resistance is dramatically increased with the inclusion of Exxpro® brand polymer via the EPDM/Exxpro® compatibalizing base polymer described above).

For added performance, a superabsorber can also be incorporated into the membrane formulation, whereby if a tear or pinhole occurs in the membrane and moisture penetrates the tear, the superabsorber will swell, thereby sealing the breach. The isobutylene portion of the roofing membrane is prone to fusing to itself, and the swelling of the superabsorber polymer pushes the polyisobutylene together, thereby re-sealing the membrane in the event of puncture, tear or the like.

Other functionalized segments can be reacted to the polyisobutylene precursor, such as, maleic anhydride functionalized alpha olefin homopolymers and copolymers. The maleic anhydride can be used to graft the alpha olefin homopolymer or copolymer to the isobutylene copolymer. The resulting hybrid polymer can then be used as a compatibalizer for blending polyisobutylene type polymers with alpha olefin homopolymer or copolymer. The polyisobutylene portion of the blend will generally provide toughness, elasticity, impact strength, melt strength, "softness" (the Tg of isobutylenes are generally about −60° F. or less, and the polyisobutylene portion can therefore reduce "brittleness" or the like when blended with a higher Tg alpha olefin homopolymer or copolymer), and in the case of an Exxpro® brand polyisobutylene copolymer, improved resistance to UV degradation.

In one preferred embodiment, the base polymers of the present invention are used alone or in combination with one or more other polymers for use in wire coating applications. In such an application, a higher Tg thermoplastic can be combined with or compatibalized by the grafted isobutylene copolymer. The resulting composition would have excellent extrudability and adhesion to metal. Furthermore, the coating could be made to be self-sealing, due to the self-fusing nature of the base polymer, particularly where a superabsorber is incorporated into the coating (the superabsorber will swell, if contacted by moisture and press the sealant together, re-sealing any breach). Such a coating is particularly well suited for high performance applications which are prone to cracking or biting (gnawing) by rodents and the like. The base polymer will provide resilience against cracking and will provide softness which will generally discourage animals from biting the wire; furthermore, the coating can be designed to be self-sealing and can incorporate an animal repellant, such as a terpene. Animal repellants in wire coatings have generally been flawed, because by the time the repellant repells the animal, significant damage is already done to the coating. The self-sealing nature of the present invention is therefore better suited for animal repellant containing wire coatings.

Polymer chemistry is a rather mature technology, and advances in polymer chemistry are likely not to arise from wholly new polymers, but rather, from innovative combinations or modifications of existing polymers. The present invention opens a whole new door in fine tuning existing polymer materials by providing a means for blending polyisobutylene (or similar-type) copolymers with any one of a number of other polymers which previously were too incompatible to allow for blending. Such blending of incompatible polymers can include blending non-elastic plastics with elastic plastics (or thermosets) to provide elastomeric thermoplastics with advantageous properties from each component (the elastic (i.e., isobutylene) component can provide toughness and impact resistance and the non-elastic component can provide improved flow, thermoformability, moldability and the like).

Alternative Base Polymer Application: Toughened Polystyrene Polymers

The grafted isobutylene base polymers of the present invention can be incorporated with a polystyrene compatible graft and used to toughen polystyrene and improve its resistance to chemical attack.

Crosslinking

Where the segment has more than one site for reacting with the precursor polymer (i.e., where the amine is a primary amine capable of bonding to two precursor polymers due to the loss of both amine hydrogens and subsequent addition of the two precursor polymers) the segment can act as a crosslinker by reacting with more than one precursor polymer. Where crosslinking occurs too quickly during the grafting process, causing unwanted scorching problems: i. a lower concentration of grafting segment can be used; ii. magnesium oxide or similar type material can be added to slow the grafting reaction; or iii. a phenol or similar type moiety having electron withdrawing functionality can be used near the reactive moiety of the grafting segment to slow the grafting reaction.

Where the precursor polymer is an Exxpro® brand polyisobutylene copolymer, the amine, silanol or thiol (i.e., crosslinking) reaction will generally continue at room temperature, albeit over a rather long period of time (i.e., a few months or more). Alternatively, such as in the case of bromo-butyls, a post cure process can be undertaken to fully cure the sealant, if desired. Generally speaking, uncrosslinked and partially crosslinked sealants will have better permeation into a substrate relative to highly crosslinked sealants; however, as crosslink density increases, compression set and creep generally decreases. Hence, appropriate crosslink density should be chosen in accordance with the end use application.

Where softness and compression set is valued (and therefore crosslinking is undesirable), then each segment preferably comprises functionality capable of only one reaction with the precursor polymer; hence secondary amines would be preferred over primary amines or in another example, only a single maleic anhydride (or other singular reactive moiety) should be present per segment (prior to reacting to the precursor copolymer) to avoid crosslinking.

Alternative Use For Grafted Isobutylene Copolymer: Low Density Sealants

In one embodiment, a low density filler, such as glass beads or polymeric beads is used. Since the sealants of the present invention have excellent adhesion, even to polyethylene, a preferred low density filler is glass or a polyolefin polymer or copolymer bead or microballoon, particularly a polyethylene polymer or copolymer bead. Alternatively, a silicone, urethane or other foam material can be coated with a sealant of the present invention, because such sealants have excellent adhesion, even to silicone, urethane, styrene, or any other composition commonly foamed. Silicone is the most preferred foam due to its weatherability, durability and compression resistance.

In a preferred method of using a low density sealant, the sealant coated foam is applied between two substrates, and the substrates are compressed together using a mechanical fastener or the like. The sealant of the present invention generally provides excellent adhesion to the substrate and to the foam, and the compression resistant foam generally supports a tight seal. In a preferred embodiment, silicone foam is coated with silane grafted PMSI copolymer sealant, because of the weather resistance of both the silicone and the PMSI ("Exxpro®" brand) copolymer. Such a system is well suited for high performance applications, such as:

i. in the application of sheathing to aircraft, buildings, ships or the like;

ii. sealing custom roofs or roof attachments to conversion vans, campers, mobile homes, buildings or the like; and iii. sealing automotive or similar type transportation vehicle substrates or parts together.

In another embodiment, a sealant coated foam is applied between logs during the building of a log cabin type home; the sealant coated foam is compressed between adjacent logs, thereby sealing the seam between log components.

In Situ Sealant Chemistry

In an alternative embodiment, low molecular weight base polymers or base polymer precursors can be applied to a substrate and the segment can be grafted in situ, whereby each segment has more than one reactive site for the base polymer precursor and therefore the base polymer can be formulated and reacted or crosslinked while it is in contact with a substrate. Alternatively, a multifunctional segment can be grafted onto a low molecular weight precursor polymer, and the resulting base polymer can be applied to a substrate; thereafter, the remaining reactive moieties of the graft segment can be used to crosslink the base polymer (after it has been applied to a substrate).

Self-Splicing Sealant Strips

Facie gaskets are placed around the outside of windows of certain types of commercial buildings. These gaskets are either joined together by a high temperature vulcanization adhesion system or the ends are merely pushed together and covered with caulk. The sealant strips of the present invention can be formulated into such (preferably crosslinked elastomer) gaskets, and advantageously, the strips can be cut (to provide clean surfaces) and merely pressed (and thereby bonded) together.

The silane grafted isobutylene copolymer sealant systems of the present invention tenaciously bond to themselves, and can be formulated to adhere as tightly together as a butyl rubber gasket which has been spliced together using a conventional high temperature vulcanization adhesive system. The self-splicing sealant strips of the present invention are not limited merely to facie gaskets, but can be used anywhere where sections of a gasket or rubber strip are assembled and bonded together. The self-splicing strips of the present invention can dramatically lower labor cost and worker error due to the simplicity of use and ease of repair.

Protective Tapes and Coatings

The sealants of the present invention have such excellent self-adhesion, that they are particularly well suited for encapsulating electrical or electronic components or the like, particularly where the tape or coating further comprises at least about 5 weight percent conductive filler, such as, carbon black or metallic particles. The sealants will readily seal to themselves around an electrical or electronic component to form a resilient, weather tight seal. Indeed, a film of sealant can be folded over a circuit board and sealed to itself with wires protruding from the seam (the sealant is pressed tight together around the wires) and the encapsulated circuit board can be immersed in water without deleterious effects to the operations of the circuit board (first, the circuit board is kept dry, since the sealant seams are extremely water resistant, and second, the sealant has proper dielectric properties (particularly when loaded with at least 5 weight percent conductive particles) to slowly bleed off any static charge (if the sealant were too conductive, short circuits could occur and if too resistive, static charge would tend to build, causing sudden unwanted arcing across interfaces).

Repair Tape

The sealants of the present invention have such tenacious self adhesion, that a tape can be wound around a substrate to provide a repair coating or protective coating. Indeed, a sealant tape of the present invention can provide a simple, long term repair to a broken automotive radiator hose. Similarly, the repair tapes of the present invention can be used to seal or repair virtually any substrate, due to the tenacious adhesion properties of the sealants of the present invention. Optionally, the sealant can be supported by a film, such as polyvinyl chloride or polyethylene terephthalate (i.e., an electrical tape).

Weather Barrier

The sealants of the present invention can be excellent films for roofing underlayments or the like, because the sealant films have excellent adhesion to wood and metal, and because film layers can be overlapped and the contacting sealant will tenaciously bond to itself. The PMSI based sealant have excellent weatherability and will seal around nails or other mechanical fasteners puncturing the film. Sealing around punctures can be enhanced by incorporating superabsorber materials into the sealant to swell upon the presence of water to further push the sealant together, causing the material to fuse together. The sealants of the present invention can be used to seal around roofing hardware or the like.

Roofing, Automotive, Marine, Appliances, Etc.

The sealants of the present invention can be used to bond roofing membranes together, particularly EPDM based roofing membranes. Alternatively, the sealants can be used to bond or seal to any one of a number of automotive substrates, appliance substrates (i.e., metal or plastic) or the like, particularly in uses previously involving conventional butyl rubber sealants.

Due to the improved compatibility with other rubbers and improved weatherability (in the case of the preferred "Exxpro®" type PMSI based sealants of the present invention), the base polymers of the present invention could advantageously be used in the construction of automobile or similar type tires. Indeed, a major problem in the past with using isobutylene polymer in tire applications has been incompatibility with other rubbers (and lack sufficient adhesion to metal); by solving this problem, whole new tire rubber and rubber alloy compositions are possible, using the base polymers of the present invention, i.e., coatings or strips of grafted isobutylene copolymer sealant can be used to provide self-sealing tires or the like.

Particularly in the embodiments using silane based graft segments, the base polymers of the present invention are particularly well suited for use with high performance reinforcing fillers, such as fiberglass, Kevlar® fibers, metal and the like. Such high performance reinforcing fillers are prevalent in a number of industries, including tires, aerospace, defense, automotive and industries using engineering polymers/rubbers. A preferred article comprising base polymer of the present invention together with high performance reinforcing fillers are bumpers or other protective articles for automobiles or the like, particularly colored bumpers and also for high performance, highly durable innertubes or the like.

Non-Stick Or Low-Friction Articles Or Coatings

Generally speaking, lower surface energy materials can stick to higher surface energy materials, but not vice versa. For instance, fluoropolymers (i.e., Teflon®), when in a flowable state, will readily stick to many substrates, including metal (which is a rather difficult substrate for many polymers to adhere to); however, once the fluoropolymer reaches a solid state, it generally can no longer be adhered onto something, but rather, something must be adhered onto it, if at all. Due to its extremely low surface energy, very few flowable materials are able to adhere to solid state fluoropolymers (i.e., Teflon®).

And so it is with the base polymers of the present invention—when soft and flowable or semi-flowable, they have excellent adhesion capabilities due to their low surface energy. However, if the base polymers of the present invention are then crosslinked to such a high crosslink density to essentially eliminate flow of the polymer, then an "adhesion resistant" surface is possible, particularly where the graft segment is or becomes crystalline and/or glassy (is below its glass transition temperature under ambient conditions). A preferred such segment is a halopolymer oligomer, particularly an amine functionalized fluorocarbon. The grafted isobutylene polymer could be used as a compatibalizer or otherwise blended with other fluoropolymers, isobutylene based polymers, or the like. Uses for such compositions would include flexible, low friction coatings, gaskets or other articles for machinery or the like. Such materials would generally provide excellent durability and high temperature performance.

Coated Fasteners

The sealants of the present invention can be applied to fastener surfaces to provide improved bonding between fastener components. The sealants of the present invention are particularly well suited for this use, because they adhere to such a wide variety of substrates include metals, metal alloys and coated metals, and also because the sealants of the present invention can be formulated to have tenacious self-adhesion properties.

Solar Heat Exchang

The sealants of the present invention, particularly the PMSI based sealants of the present invention, have excellent weatherability and water resistance. Hence sealant strips of the present invention would be useful in building solar heat exchanges, such as for swimming pools, since the strip could define a labyrinthine path between two panes of glass, between which water can flow and be heated by solar energy.

Hot Melts

The base polymers of the present invention can be incorporated into butyl rubber type hot melt formulations, wherein all or part of the butyl rubber component is replaced with a base polymer or base polymer precursor of the present invention. The graft segment can be designed to have a functionality which unblocks with heat, and in this way, the hot melt operation could activate the grafting reaction and/or crosslinking of the isobutylene copolymer precursor, causing the composition to be a reactive hot melt. DuPont Diak® brand blocked amines can be used to unblock an amine functionality during heating; in a preferred embodiment, the unblocked amine can then react with the benzyl bromide of the PMSI based sealants of the present invention, thereby grafting and/or crosslinking the PMSI polymer as the hot melt is being applied to the substrate.

Other Uses

The number of possible uses of the sealants of the present invention is limited perhaps only by the imagination of the reader. Conventional isobutylene based sealants are well known and are used on a large scale. The graft chemistry of the present invention dramatically increases the performance of isobutylene based sealants, providing them with amazing performance characteristics, beyond what was previously possible for an isobutylene or butyl based adhesives, particularly for a crosslinked isobutylene copolymer. The isobutylene sealants of the present invention bond to substrates (even when crosslinked) which generally are not possible using conventional isobutylene chemistry.

Indeed, the sealants of the present invention would be useful in sealing polyethylene membranes together, such as, for pond liners or the like (polyethylene is generally regarded as a very difficult substrate upon which to bond; however, the preferred sealants of the present invention have sufficiently low surface energy and sufficient flow to provide the necessary bond strength).

Furthermore, the water resistance, self adhesion and self sealing (particularly when superabsorbers are incorporated into the sealant) characteristics allow the sealants of the present invention to be useful in applications previously beyond the performance capabilities of conventional isobutylene based adhesives. Beyond adhesion, potential other uses of the sealant chemistry of the present invention include blending with any one of a number of other polymers or inorganics, such as cement or concrete to provide toughness, impact strength, elasticity and the like.

DETAILED DESCRIPTION OF THE PREFERRED EMBODIMENT(S) AND BEST MODE

Figure 1:
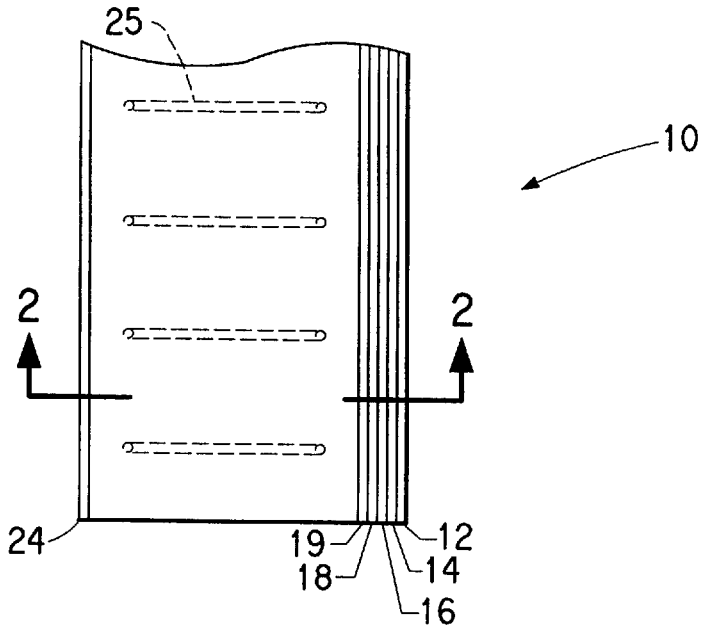
FIG. 1 is a top view of the window strip preferred embodiment of the present invention.
Figure 2:
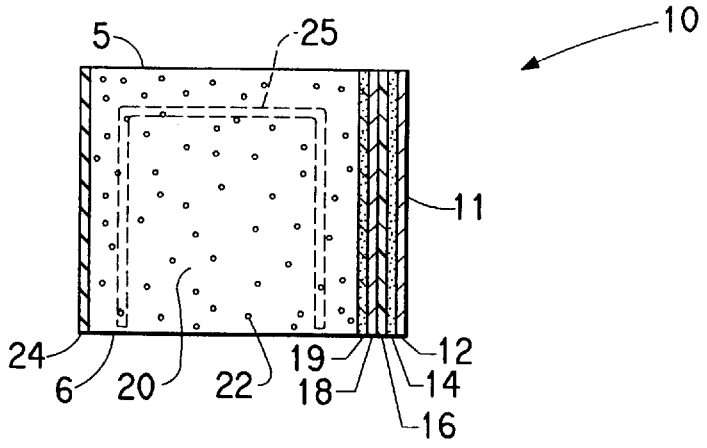
FIG. 2 is a cut-away, perspective view according to 2—2 of FIG. 1.

A preferred embodiment of the present invention is a window strip as shown generally at 10 in FIG. 1 (top view) and FIG. 2 (cut-away side view). The window strip is preferably installed between two window panes (one pane contacting the top surface 5 of the strip and the other pane contacting the bottom surface 6). In the FIG. 1 embodiment, the strip comprises a multi-layer composite strip 11, comprising a vapor barrier layer 16, and (optionally) a heat seal layer 12. Optionally, an adhesive layer 14 is used to enhance bonding between the heat seal layer 12 and the vapor barrier layer 16.

Optionally, a support layer can be placed anywhere within the strip, such as, at 18. Optionally, a desiccating layer 19 is used, whereby the layer is permeable to moisture and contains a desiccating agent. Alternatively, a desiccant 22 can be interspersed within the base matrix 20 of the strip.

The base matrix 20 of the strip preferably comprises a polyisobutylene copolymer. The preferred polyisobutylene copolymer is a brominated paramethyl styrene/isobutylene copolymer available from the Exxon Chemical Co. under the trademark name "Exxpro®D", most preferably Exxpro EMDX 90-3-1 comprising about 0.5 mole percent benzylic bromine and about 5 weight percent para-methyl styrene with the balance of the copolymer being derived substantially from isobutylene. The polymer precursor preferably comprises a viscosity average molecular weight greater than about 25,000 and less than about 1,000,000. The most preferred molecular weight is in the range of about 150,000–300,000. Alternatively, a butyl or bromobutyl can be used.

The isobutylene copolymer is preferably grafted with an amino-silane or thio-silane. The organo-silane can be of virtually any molecular weight, but preferably is a liquid at room temperature. A preferred amino silane further also comprises phenol amine functionality.

The window strip base matrix 20 is preferably formulated by blending a composition comprising:

i. greater than about 10 weight percent Exxpro EMDX 90-30-1 (preferably about 25–40 wt %);

ii. from about 0.5 to about 7 weight percent amino silane (preferably about 1 wt %);

iii. from about 0.5 to about 5 weight percent zinc stearate, commercially available sulfur complex rubber curative or other curative recommended by Exxon Chemical for the curing of Exxpro® brand (preferably about 1.5 wt %);

iv. from about 15 to about 50 weight percent tackifier (preferably from about 28–45 wt %);

v. from about 5–20 weight percent molecular sieve dessicating powder (preferably about 8–12 wt. %); and vi. from about 5 to about 35 weight percent plasticizer, filler, pigment and/or other additive conventional for isobutylene copolymer type sealants.

Preferred filler is silica powder, and a preferred pigment is titanium dioxide (for colors other than white, other pigments can also be added). A preferred liquid plasticizer is polyisobutylene. A preferred tackifier is a fully saturated cycloaliphatic which is liquid at room temperature. A secondary tackifier is also preferred, such as an aliphatic having a melting point of about 100° F.

Preferably, the amino-silane ("ii." from the above list) and the curative ("iii." in the above list) are mixed with a portion of the plasticizer ("vi." from the above list) and added to a masterbatch comprising a mixture of the remaining ingredients. Once all the ingredients are mixed, the resulting composition is preferably extruded shortly thereafter. Preferably, the extrusion is conducted at a low shear rate through a heated die to minimize back pressure. The preferred mixing and extrusion temperatures are those temperatures which are the lowest possible while still obtaining intimate mixing and appropriate extrusion properties. A preferred mixing and extrusion temperature range is from about 125° F. to about 175° F., and the die temperature is preferably about 150° F.

The preferred compositions of the present invention continue to slowly cure after extrusion (the sealants generally exit the extruder about 20%–50% cured). The strips can be wound in rolls immediately after extrusion and allowed to cure while rolled. Even so, the strips have been found to easily unwind and can easily be straightened and placed straight along a glass edge. Where full curing is desired as quickly as possible, the rolls can be stored in a high temperature environment or the strip can be moved through a heat tunnel (the sealant can generally be placed in post cure temperature environments of about 350° F., but the upper temperature limit is generally dictated by the release material upon which the strip is extruded—where the release liner is paper based, the maximum temperature will be much lower (generally less than about 200° F.), whereas a polyethylene terephthalate release material can generally withstand a much higher temperature (generally somewhat greater than about 200° F.).

Extrusion processes can vary widely in the industry, and where scorching problems are encountered: 1. the extrusion temperature should be lowered, if possible; 2. magnesium oxide can be added to retard the cure (approximately 0.25 weight percent, initially, then incrementally greater thereafter, if needed); 3. the amount of curative can be gradually decreased until scorching is eliminated, provided sufficient crosslink density is nevertheless obtained to sufficiently inhibit creep ("creep" is less of a concern where other strip components are added to inhibit creep, such as, the use of mechanical inserts or a continuous corrugated metal strip (or the like) or where the strip is bonded to a film or other material which is bonded to the glass, thereby anchoring the strip in place and inhibiting creep); and 4. Exxon Chemical Co. or a rubber curative supplier should be consulted to obtain a less reactive curative (where less reactive curatives are used, a post cure, i.e., heat tunnel is generally necessary).

During mixing and extrusion, the amino-silane will react with the benzyl bromide portion of the isobutylene copolymer precursor, thereby grafting the precursor with a silane segment. This silane segment dramatically improves bonding to glass by the sealant strip.

The preferred final sealant material in non-deformable. That is, the strip will have no compression set (or at least, a compression set of less than about 5 mils, and more preferably less than about 3 mils), during the fabrication of an insulated glass unit, and thereafter. Preferably, the vapor barrier will be deformable; that is, will not be able to withstand compression during typical insulated glass fabrication, and thereafter. Compression resistant mechanical inserts may be incorporated into the strip, but are not preferred.

Optionally, a cover layer 24 is applied to the face of the strip. The cover layer may be decorative or functional, such as, comprising a desiccating agent, an agent for eliminating chemical fog, a vapor barrier material or the like. Any of the above layers may include an adhesive or adhesive promoter to enhance bonding between the different elements of the strip. Other optional elements may also be added to the strip, as necessary, such as, colorants, binders, fillers, stabilizers and the like. Optionally, the different layers described above can be incorporated into the window strip by means of multiple separate films which in combination comprise all the desired layers.

Optionally, a staple 25 or similar-type compression resistant article is incorporated into the strip to inhibit strip compression (or other movement) beyond a particular limit. The staple is preferably of a sufficiently durable is material to resist substantial bending or breaking during normal use (particularly compression) of the strip. The staple can also be advantageous to inhibit creep. The staple can generally resist such creep, particularly where the staple lies perpendicular to the nearby edge of the glass. Advantageous staple designs include those having elongated baffles or other protrusions perpendicular to the plane of the anticipated flow. Other mechanical configurations are also possible, such as squares, beads, stars, "X" shapes and the like. Alternatively, a corrugated or undulating, solid ribbon of material can be incorporated into the strip as a compression resistant article.

Preferably however, the sealant material is sufficiently crosslinked, so that compression resistant inserts or reinforcing strips are unnecessary, and the sealant is compression resistant (and will resist creep) by itself. The most preferred sealants are compression resistant during insulated glass fabrication and thereafter. Preferably, the sealant preferably less than 5 mils, more preferably less than 3 mils, during typical insulated glass fabrication, and the compressed sealant will preferably substantially regain its original shape if the insulated glass unit were disassembled. Therefore, the composite strip 11 and/or the base matrix 20 of the strip have a height substantially the same as the desired space between the glass panes upon final window strip installation.

Figure 3:
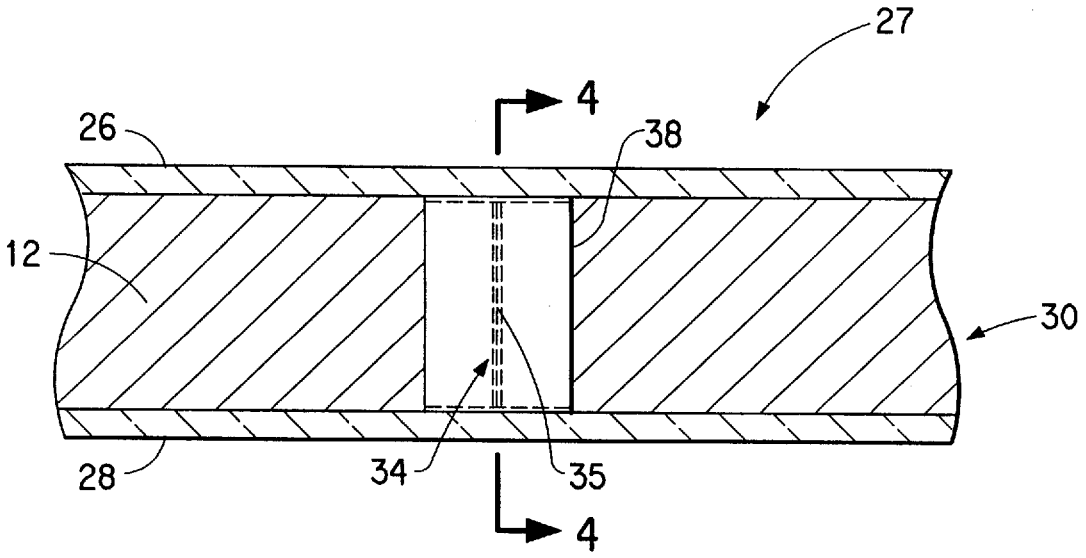
FIG. 3 is a perspective view of a means or method for sealing the ends of a window strip together during installation.
Figure 4:
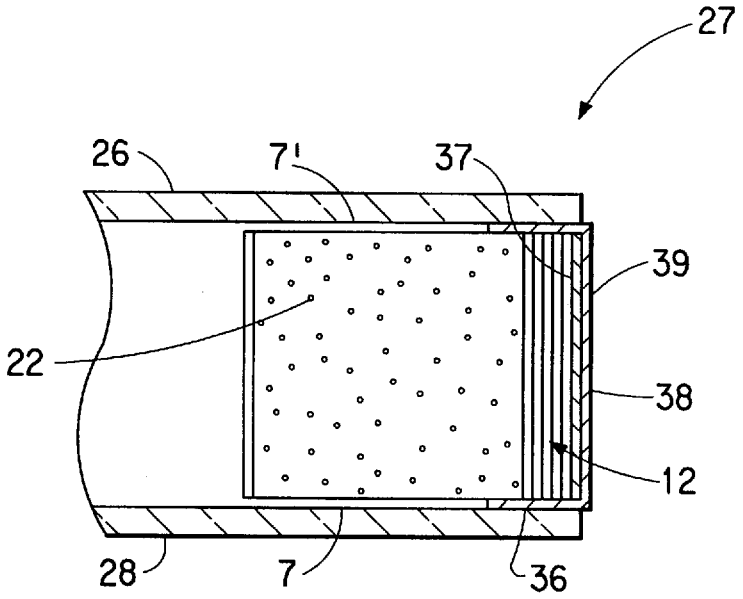
FIG. 4 is a cut away perspective view according to 4—4 of FIG. 3.

Window strip installation is illustrated generally at 27 in FIG. 3 and FIG. 4. As shown in these figures, the window strip 30 is place between a first window pane 26 and a second window pane 28.

The strip is preferably wrapped around the entire periphery of the glass panes and butt-jointed together as shown generally at 34. The space between the two ends is exaggerated merely to illustrate the butt-joint. In a more preferred installation, the two ends are firmly pressed together (the strip can be butt-jointed "end-to-end" or "end-to-front side", whereby the "end-to-front side" butt jointing can be done if the strip is started at a comer and wound around, such that as the strip comes around and passes the first end of the strip, the front side of the second end of the strip can be pressed against the end surface of the other end of the strip, thereby sealing the strip to itself). Preferably, the butt-joint seam 35 will be defined by an adhesive bond is between the two ends. However, to further seal the two ends of the strip and further impede moisture penetration into the enclosed air space between the two panes, an overlap strip 38 can be placed over the seam.

Overlap strip 38 can be adhesively bonded to the edge of the glass pane, such as with an anhydride grafted polyolefin adhesive, hot melt butyl, hot melt polysulfide, low modulous ionomer or the like. Such an adhesive can be separately applied or can be applied first as a layer upon the overlap strip and thereafter bonded to the glass by pressure and/or heat. The overlap strip preferably comprises a vapor barrier layer, such as a vacuum deposited layer of aluminum or the like. The overlap strip also preferably also comprises an outer heat seal layer 37 which is capable of heat sealing to the outer heat seal layer 12 of the window strip.

In a preferred method of installation, the overlap strip 38 is place on the periphery of a pane of glass. The initial strip end is then place in the middle (and on top) of the overlap strip 38 at the periphery of the glass pane, and the rest of the strip is then place around the periphery of the glass pane and ultimately butt-jointed to itself on top of the overlap strip. The overlap strip is then pivoted toward the strip and pressed onto the strip, whereby the heat seal layer of the overlap strip 38 is pressed either onto the heat seal layer 12 of the strip 30 (as shown in FIG. 3) or optionally onto a complementary overlap strip 37 (as shown in FIG. 4). Heat is then applied from an independent heat source to heat seal the overlap strip(s) which in turn heat seal to the outer layer 12 of the sealant strip (in place of the heat seal, an adhesive could alternatively be used).

Figure 7:
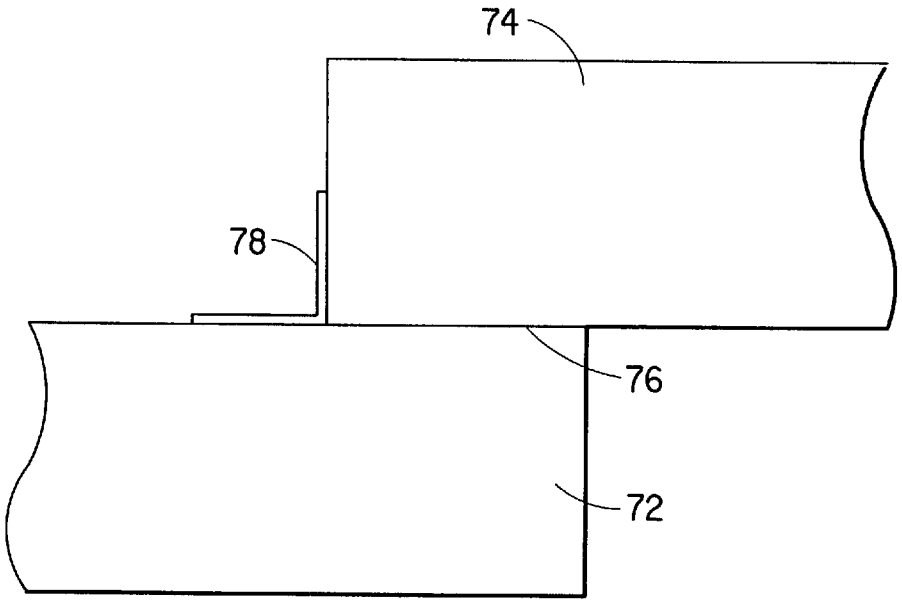
FIG. 7 is a perspective view of an alternative means or method for sealing the ends of a window strip together during installation.

The overlap strip is preferably cut so that it only slightly protrudes over the top of the strip, so the overlap strip fully heat seals the entire seam. Thereafter, the top glass pane can be placed over the strip and pressed in place. Optionally, a complementary secondary overlap strip is also used, which will overlap and heat seal to the other side of the first overlap strip, thereby providing even further sealing of the strip at the butt-joint. Alternatively, a butt-joint is not used, and an overlap joint is used instead, such as shown in FIG. 7 or in combination with the overlap strip design shown in FIG. 16. In one preferred embodiment, the base matrix has sufficient flow to span the space 7 and 7' which occurs due to the presence of layer 39. Alternatively, an adhesive or similar-type layer can be placed with this space to enhance bonding between the strip and each adjacent glass surface.

Figure 5:
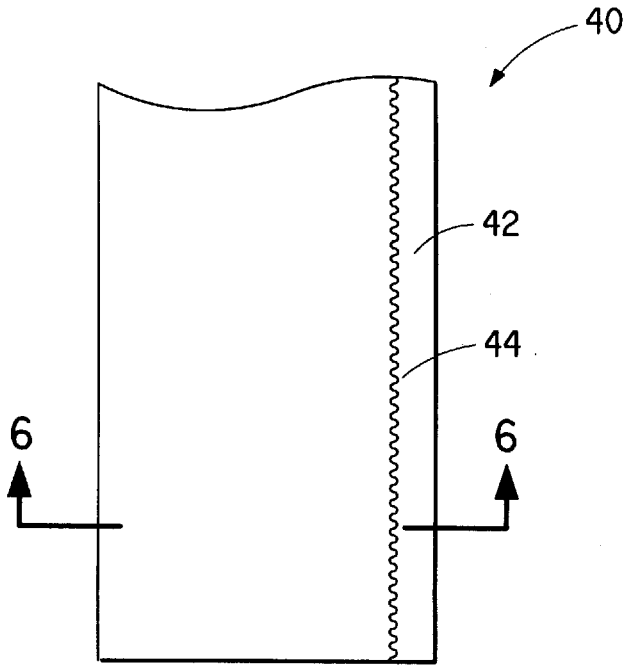
FIG. 5 is a top view of an alternative embodiment of the present invention.
Figure 6:
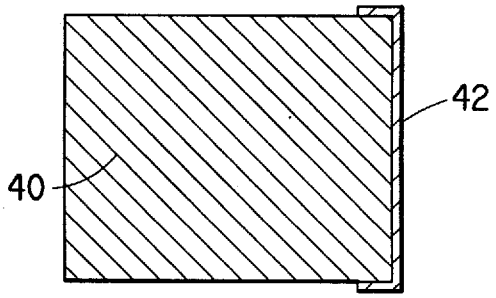
FIG. 6 is a cut away perspective view according to 6—6 of FIG. 5.

FIG. 5 and FIG. 6 show a first alternative preferred embodiment of the present invention which provides an effective seal between the top and bottom edges of the strip and the glass panes. In this embodiment, the film 42 extends the entire height of the strip 40 and bends over at least a portion of the top and bottom surface of the strip. In this way, the vapor barrier film will contact and preferably seal to the surfaces of each glass pane.

This top and bottom region of the vapor barrier film can tend to wrinkle or buckle as the strip is bent around corners, and therefore the film should preferably only slightly extend over the top and bottom edges of the strip. Although a straight cut has been found to be generally acceptable, to alleviate buckling or wrinkling, the edges of the vapor barrier film on the top and bottom surfaces of the strip can be cut in a zigzag arrangement (or a plurality of semi-circles) and preferably the continuous portion of the film (just before the zigzag or multiple semicircle configurations occur) extends just barely over the top (and bottom) edge of the strip. In this way, as the strip is placed along the periphery of the glass, a continuous vapor barrier film will span between the glass panes. The zigzag or semi-circle configurations which are substantially parallel to the glass panes are helpful in allowing the strip to be bent around corners without having the film bunch up, buckle, wrinkle or otherwise create a non-uniform film surface upon which the glass plane can be applied (since the "cut-outs" which define the zigzag or semi-circle edge lines allow the sections of film to move together as the strip is bent around a comer without causing buckling or wrinkling).

Alternatively, the strip can comprise a film 304 which extends far beyond the width of the strip as shown generally at 300 in FIG. 18*a*. In this embodiment, the base matrix 302 is inserted between the window panes and the film is wrapped around the outer edges of the window panes as shown generally at 306 in FIG. 18. Preferably, the corners of the film are cut, so there is no wrinkling. In the most preferred embodiment, an adhesion promoter can be used to improve adhesion between the glass panes and the film.

Where the vapor barrier film merely extends from the top to the bottom of the strip (is only perpendicular to the glass panes and does not bend over the top or bottom edge), a tiny seam can arise between the surface(s) of the glass and the top and bottom edges of the strip. Although this seam can allow moisture vapor penetration over time and therefore is less preferred, such a design has been found to generally be acceptable (the zigzag or semi-circle film edge configurations shown at 44 in FIG. 5 are more preferred).

In an alternative to butt-jointing the ends of the strip together, FIG. 7 illustrates an overlap joint, wherein the ends, 74 and 72 of the strip are overlapped and pressed or otherwise sealed together. An adhesive can be applied at the seam 76 to enhance the seal between the two ends of the strip. Alternatively, the seam can be sealed with a film 78 applied across the seam between the two strip ends. The film 78 can be adhesively applied or heat sealed in place to provide a substantial vapor barrier seal. Film 78 is preferably a metalized film having a heat seal layer sufficient to heat seal to the two strip surfaces.

The above disclosure is provided merely to enable those of ordinary skill to practice the best mode and preferred embodiment(s) of the present invention. Other embodiments are possible and ordinary skill and experimentation may be necessary in practicing any particular embodiment of this invention. The limitations of the present invention are intended to be defined solely by the following claims.

What is claimed is:

1. An insulated unit comprising:

a sealant strip having a top surface and a bottom surface, said strip being located under a top pane and over a bottom pane, the top pane being bonded to the top surface of the sealant strip, and the bottom pane being bonded to the bottom surface of the sealant strip, the sealant strip extending around a periphery of the top and bottom panes to thereby create a sealed space between the top pane and the bottom panes, said sealant strip comprising about 15 to about 50 weight percent tackifier and comprising an isobutylene copolymer grafted with an organo-silane.

2. An insulated unit in accordance with claim 1, wherein said strip is compression resistant due to crosslinking, branching, grafting or reinforcing fillers, and has movement capability to accommodate stresses on the insulated unit, and said strip is devoid of a compression resistant article which inhibits strip compression beyond a particular limit.

3. An insulated unit in accordance with claim 1, wherein the sealant strip further comprises a vapor barrier.

4. An insulated unit in accordance with claim 3, wherein the vapor barrier is less than about 1000 Angstroms thick.

5. An insulated unit in accordance with claim 3, wherein the vapor barrier is substantially parallel to the outer surface of the sealant strip and bends over a top surface or a bottom surface of the sealant strip.

* * * * *